US005413825A

United States Patent [19]

Chaikin

[11] Patent Number: 5,413,825

[45] Date of Patent: May 9, 1995

[54] ARTIFICIAL CHRISTMAS TREE

[76] Inventor: Clarice M. Chaikin, 906 Four Mile Post Rd., Huntsville, Ala. 35802

[21] Appl. No.: 245,590

[22] Filed: May 18, 1994

[51] Int. Cl.[6] ..... A47G 33/06

[52] U.S. Cl. ..... 428/18; 211/196; 362/123; 428/20

[58] Field of Search ..... 428/20, 18; 362/123; 211/196, 205

[56] References Cited

U.S. PATENT DOCUMENTS

| | | | |
|---|---|---|---|
| 3,594,260 | 7/1971 | Dieffenbach | 428/20 |
| 3,677,867 | 7/1972 | Westlund | 428/20 X |
| 4,130,678 | 12/1978 | Higgins | 428/20 X |
| 4,156,892 | 5/1979 | Fisher | 428/20 X |
| 4,331,720 | 5/1982 | Vin Dick et al. | 428/20 X |
| 4,968,541 | 11/1990 | McCrory | 428/20 X |

*Primary Examiner*—Henry F. Epstein
*Attorney, Agent, or Firm*—Joseph H. Beumer

[57] ABSTRACT

A collapsible artificial Christmas tree has a center pole erectable on a base, a cap that fits over the top of the pole, and a spiral coil of split plastic tubing, which extends upward to form a conical shape when the cap is placed on the pole. The split plastic tubing carries an electrical wire inside the tubing with sockets and bulbs extending outwardly between edges of the tubing at intervals. Stringers in the form of plastic line are connected to the base and cap as well as to the split tubing to cause the spiral coil to assume the proper shape. In addition to serving as a tree stand, the base and its cover provide a storage box in which the spiral coil and other parts of the tree are stored. The use of metal parts in proximity to electrical wires is avoided.

12 Claims, 2 Drawing Sheets

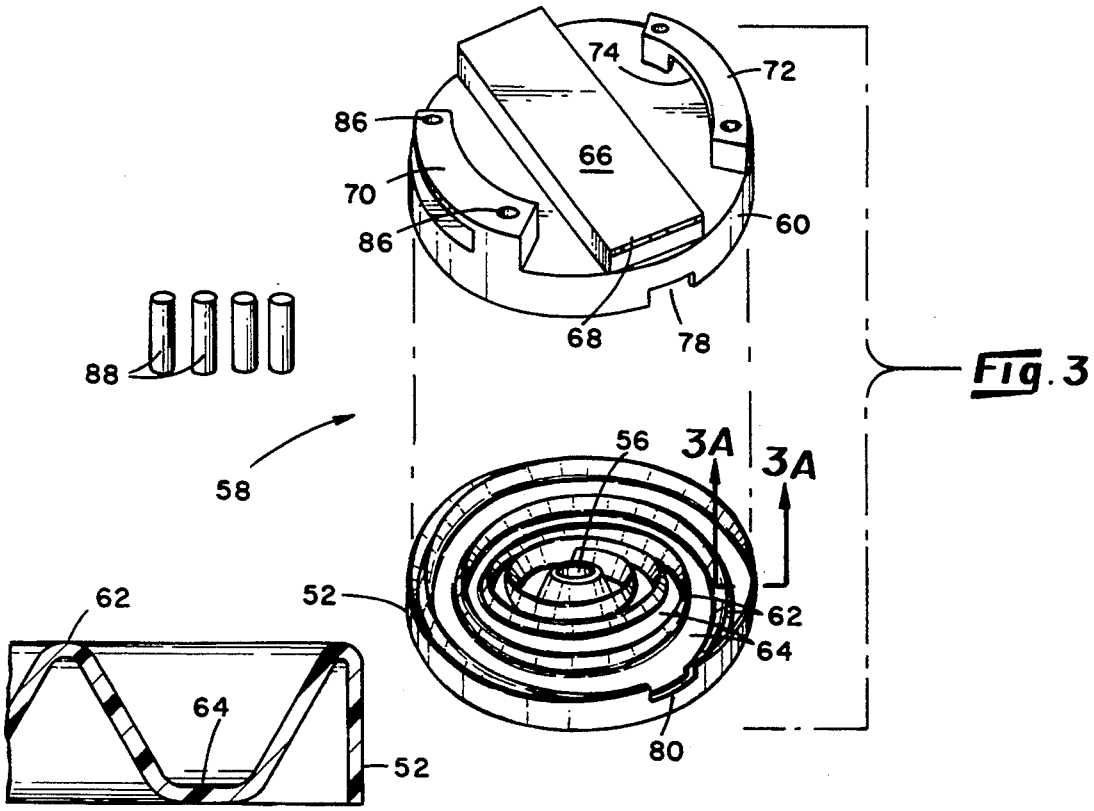
Fig. 3
Fig. 3A
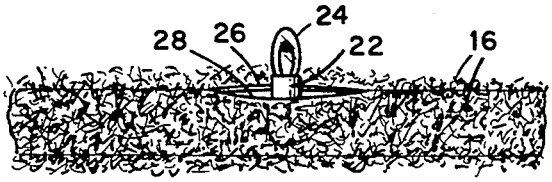
Fig. 4
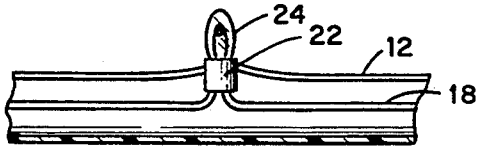
Fig. 5
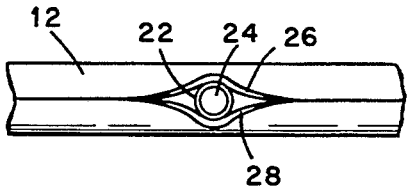
Fig. 6

ARTIFICIAL CHRISTMAS TREE

FIELD OF THE INVENTION

This invention relates to collapsible artificial Christmas trees.

BACKGROUND OF THE INVENTION

Artificial Christmas tree assemblies have been provided in various forms and arrangements in the prior art. One approach simulates a natural tree by using an upright center pole with slots arranged to receive limbs or branches of appropriate lengths to form a conical evergreen tree shape and appearance. The branches and center pole require a large storage box, and ornaments and lights generally require additional storage containers. These containers serve no purpose once the tree is erected and must themselves be stored until reused. Assembly of the tree, stringing of the lights, and placement of ornaments or other decorations are time consuming and must be repeated each time the tree is used.

Another type of artificial Christmas tree employs a series of progressively smaller circular hoops or a spiral-wound heavy wire supported on a central pole to obtain a conical tree shape without the use of radially extending limbs attached to the pole. This approach is exemplified by U.S. Pat. No. 4,968,541, issued on Nov. 6, 1990, to McCrory, which discloses a series of graduated circular hoops connected to a center pole by stringers, and each hoop having limbs or branches secured thereto. Electrical lights are attached to the limb sections or to the stringers. U.S. Pat. No. 3,677,867, issued on Jul. 18, 1972, to Westlund, discloses a collapsible tree having a resilient, spring-like metal spiral frame member that forms a conical shape with a tapering series of convolutions upon being pulled upward and supported on a center pole. The frame member is located inside an insulating sheath. The convolutions are secured in vertical spaced relation by suspension hangers, and tinsel ropes and an electrical cord are wound loosely around the insulated frame members along its length. A spiral frame member made of stiff wire is disclosed in U.S. Pat. No. 4,331,720, issued on May 25, 1982, to Van Dick et al. The wire carries an artificial pine covering and an electrical lamp system. The patent states that the stiff spiral wire may be bent to provide a more natural look. This patent also discloses mounting of the center pole on its container case, which serves as a stand for the tree.

The prior art Christmas trees present a disadvantage in the manner in which electrical lamp cords are carried on spiral wire support members. If the lamp cord insulation became frayed, hazardous electrical shorts could result upon making contact of the electric wire member with the support wire. It would be preferable to provide an unfolding spiral structure without use of a strong metal wire for the spiral support so that protection against shorting of the lamp cord would be provided. Prevention of electrical wires or cords from becoming twisted, bent, or frayed in prolonged use is thus desired.

An important desired characteristic for collapsible artificial Christmas trees is an ergonomic design which emphasizes ease of handling on the part of the user and which, to the maximum extent, employs components that form an integral, visible part of the erected tree assembly and also serve an additional role in providing for containment and storage of the tree when folded up. In order to enable convenient use even by unskilled or partially disabled people, the assembly should be lightweight, compact, and simple to manage with a readily cleaned and durable container. This makes the assembly particularly attractive for small apartments, nursing homes, and other locations with limited storage space.

In addition to containing the folded-up tree, the storage box should provide a separate compartment into which components such as the support pole, connecting electrical cords and the like may be placed, thus preventing their becoming entangled with the tree during storage. Built-in handles for carrying the packed-up assembly or hanging it up in closets or similar locations are also needed.

SUMMARY OF THE INVENTION

The present invention is directed to a collapsible artificial Christmas tree assembly comprising a center pole, a container box with a socket to receive the bottom end of the pole and support it in upright position, a spiral coil of split plastic tubing having its inner end connected to a cap adapted to be placed at the top of the pole, the remainder of the coil forming convolutions of graduated increasing diameters. Upon being erected, the coil forms a conical shape structure representing the general shape of a natural tree. Convolutions of the spiral coil are maintained in position with respect to one another by stringers extending upward from the base of the tree to the cap placed at the top end of the pole and joined to the spiral coil at multiple locations. An electrical cord with Christmas lights connected at intervals is disposed within the tubing, with light bulbs extending radially outward through the sides of the split tube at those intervals. The tubing and electrical cord disposed therein form convolutions of medium flexibility so as to maintain an overall conical shape when suspended by the stringers. In addition to providing the desired shape, the split plastic tubing isolates the electrical cord and protects it from becoming frayed or twisted, thus minimizing any chance of an electrical short occurring.

It is therefore an object of this invention to provide a collapsible artificial Christmas tree wherein use of metal wire parts forming a part of the support structure of the tree is avoided.

Another object is to provide an artificial Christmas tree that may be readily erected and folded up for storage in a compact container.

Yet another object is to provide a collapsible Christmas tree assembly including components that form a storage container and a portion of the erected assembly.

Still another object is to provide a collapsible Christmas tree assembly in which a spiral support member providing a conical shape is adapted to protect an electrical cord disposed thereon.

Other objects and ergonomic advantages of the invention will be apparent from the following detailed description.

BRIEF DESCRIPTION OF THE DRAWINGS

FIG. 3 is an exploded view of the upper and lower portions of the combined storage case and supporting base for the tree.

FIG. 3A is an enlarged sectional view taken along line 3A—3A of FIG. 3 showing details of the spiral ridges of the base member.

FIG. 4 is an enlarged view showing a segment of the split plastic tubing which makes up the spiral coil of the tree structure with attached decorative needles.

FIG. 5 is a sectional view taken along line 5—5 of FIG. 4 with needles removed.

FIG. 6 is a top view of the split plastic tubing and wire and lamp carried therein, with decorative needles removed.

DESCRIPTION OF THE PREFERRED EMBODIMENT

Figure 1:
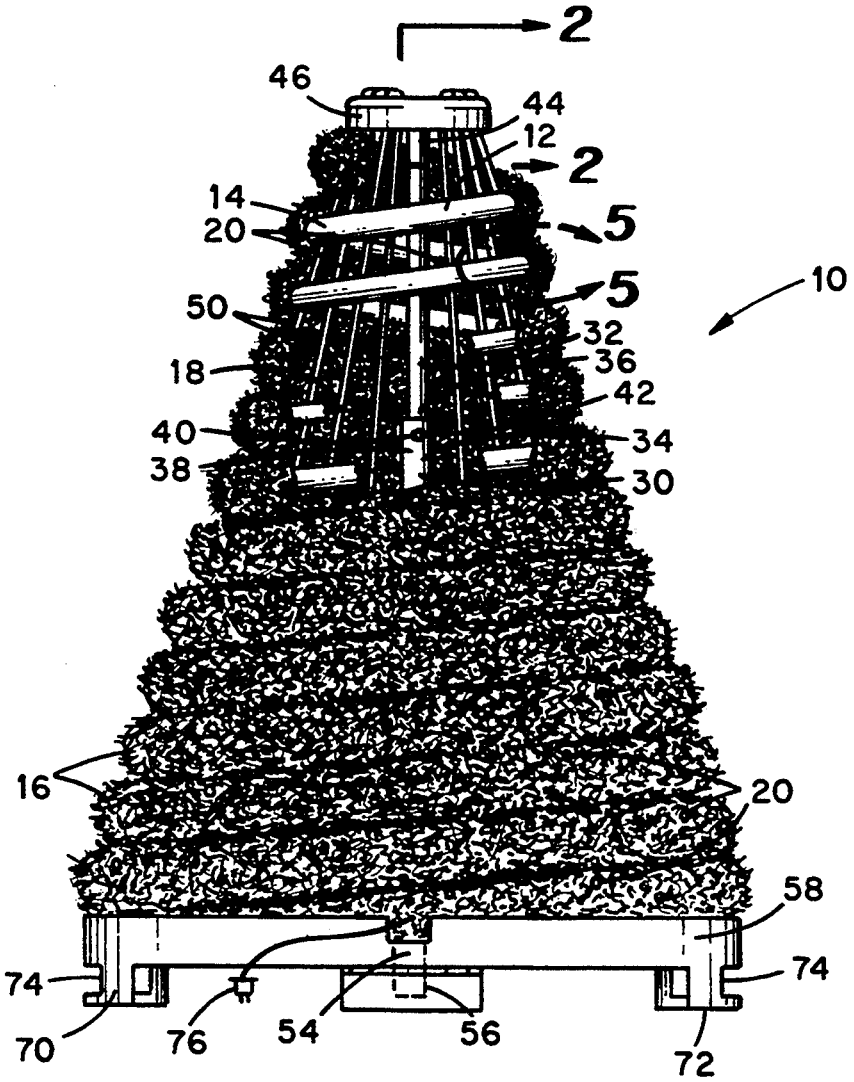
FIG. 1 is a pictorial view of an artificial Christmas tree embodying the invention, partly broken away at the top and bottom thereof and showing details of the tree and supporting structure.

Referring to FIG. 1 of the drawings, there is shown an artificial tree 10 in unfolded, upright position. Decorative features of the tree are carried by a spiral coil of split plastic tubing 12 made up of a graduated series of convolutions 14 of decreasing diameter toward the top, forming a conical shape. The split plastic tubing 12 (FIG. 4) has adhered thereto a large number of short lengths of strips 16, or needles, of material such as metal or plastic foils in some desired color, in particular, green. The needles may be attached to the plastic tubing at one end of the needles by means of an adhesive, with the opposite ends extending outward in a manner similar to porcupine quills. Other decorative materials may also be used, in particular, tinsel ropes having a central string with needles secured thereto and extending radially outward. An open mesh fabric with attached needles extending through the openings may also be used.

An electrical wire 18 is located inside the split tubing, the wire providing current to electrical lamps 20 at intervals along the length of the wire. The lamps include a socket 22 and bulb 24 placed in the socket. Edges 26, 28 of the split tubing are separated at a point where the socket extends outward through the tubing walls, the sockets being secured in place by the pinching effect exerted when the walls are pulled apart.

The tree is supported on a central mast 30 made up of an upper portion 32 and lower portion 34, with the lower end 36 of the upper portion fitting into the upper end 38 of the lower portion. The two portions are telescoped together and are removably connected by a button 40 biased outward in the upper portion and adapted to snap into aperture 42 in the lower portion.

Figure 2:
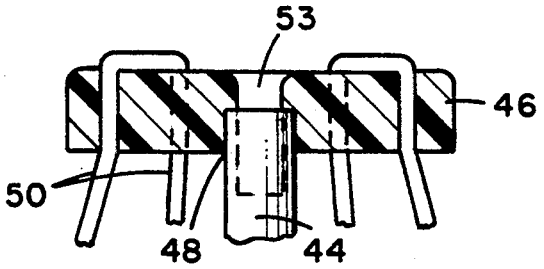
FIG. 2 is a sectional view taken along line 2—2 of FIG. 1.

Upper end 44 of the mast supports a cap 46 (FIG. 2) having a downward opening aperture 48 in which end 44 fits. A plurality of stringers 50 dispersed around the periphery of the tree are secured to supporting base 52 and to cap 46, the stringers having a length such that they become tight when the cap is placed over the end of the mast, and the mast is extended. The stringers, which may comprise plastic filament line, are also secured to the plastic tubing 12 at each intersection therewith by means such as thermal bonding. The cap also has an upward-opening aperture 53 for receiving a top ornament (not shown). As shown in FIG. 1, the stringers pass underneath or behind the spiral tubing. Lower end 54 of the mast is supported in a cylindrical socket 56 built into base member 52. Insertion of the mast in assembly of the tree provides for rigid support of the mast in upright position.

Storage case/tree support 58 includes two parts, a bottom base member 52 in which socket 56 is located for receiving the mast and a cover 60 which fits over the base member to form an enclosure when the tree is folded up. Base member 52 is provided with a series of spirally extending ridges 62 and valleys 64 to receive the tubing coil and hold it in place when the tree is disassembled, keeping the base and cover from fitting too closely together so as to avoid crushing the needles or tinsel while in storage. Placement of cap 46 over socket 56 in folding up for storage further serves to maintain the folded-up spiral tubing in an orderly condition and avoid tangling. Cover 60 is provided with a diametrically extending box 66 having a hinged lid 68 for receiving the collapsed mast portions 32 and 34 and any other items for which storage is needed, for instance, an extension cord. A pair of handles 70, 72 with graspable indentations 74 are also provided in the same plane with the box.

An electrical plug 76 connected to lamp wire 18 is secured to base member 52 and held in position for being engaged by a mating plug of an external extension cord (not shown). Slots 80, 78 are provided in an outer edge of the circumferential walls of the base member and cover to receive the external wire. Alignment of the walls with one another is required to allow passage of the cord. Alignment of the slots also serves to keep the respective members in proper keyed position in relation to one another for erection of the tree.

In assembling the tree, cover 60 is inverted and placed underneath base member 52. This in effect provides feet for keeping the base member at a slightly elevated position and also gives more strength to the base. Base member 52 also has four holes 86 providing sockets accessible from below when the tree is in its assembled position. The sockets receive and support a short length of pipe or rod 88 which may serve as optional feet if further elevation is desired.

The invention is described above in terms of a specific embodiment. It is to be understood, however, that changes and modifications may be made without departing from the spirit and scope of the invention, which is limited only as indicated by the appended claims.

I claim:

1. A collapsible artificial Christmas tree assembly comprising:

a base member;

a mast having a bottom end and a top end, said bottom end being adapted for mounting in upright position on said base member;

a spiral coil of split plastic tubing having an outer convolution thereof secured to said base member;

a cap member adapted for being removably mounted on the top end of said mast;

an inner convolution of said spiral coil being connected;

stringer means securing said convolutions to said cap in spaced-apart relation from one another;

said spiral coil carrying decorative material and an electrical wire disposed inside of said split tubing;

electrical lamps operably connected to said wire at intervals along said tubing, with bulbs thereof extending radially outwardly through walls of said tubing; and means for coupling said wire to a source of electric current.

2. The assembly as defined in claim 1 wherein said base member comprises a circular dish-like member supporting an axially placed socket removably receiving said bottom of said mast and supporting the same when in upright position.

3. The assembly as defined in claim 2 including a circular dish-like cover member matable with said base member in a first position in opposed relation thereto and defining a storage container and in a second position receiving said base member so that the base member is nested therein.

4. The assembly as defined in claim 3 wherein said cover member on an outside face when disposed to form with the base member, a container including a box extending radially across the center thereof and defining space to receive said mast for storage when said assembly is collapsed.

5. The assembly as defined in claim 4 including a plurality of handles placed on said outside face of said cover member.

6. The assembly as defined in claim 4 wherein said base member includes on its inner surface a plurality of spirally extending peaks and valleys for maintaining said spiral coil in untangled condition upon being collapsed for storage.

7. The assembly as defined in claim 1 wherein said decorative material comprises needles adhesively secured to said spiral coil.

8. The assembly as defined in claim 7 wherein said needles are brightly colored.

9. The assembly as defined in claim 1 wherein said mast comprises two vertically positionable sections adapted to be removably secured in coaxial relation to one another.

10. The assembly as defined in claim 9 wherein a first one of said sections is adapted to extend slightly into a second one thereof, and the outermost of said sections where overlapping has an aperture for receiving a radially outwardly biased snap button carried by the innermost section where overlapping.

11. The assembly as defined in claim 1 wherein said decorative material is secured to an outside surface of said split tubing.

12. The assembly as defined in claim 1 wherein said stringer means comprises a plurality of plastic filament lines bonded to said convolutions at intervals therewith.

* * * * *